US006447426B2

(12) United States Patent
Peterson

(10) Patent No.: US 6,447,426 B2
(45) Date of Patent: Sep. 10, 2002

(54) WATER TRAMPOLINE

(75) Inventor: Leroy L. Peterson, Omaha, NE (US)

(73) Assignee: Sportstuff, Inc., Omaha, NE (US)

( * ) Notice: Subject to any disclaimer, the term of this patent is extended or adjusted under 35 U.S.C. 154(b) by 0 days.

(21) Appl. No.: 09/315,665

(22) Filed: May 20, 1999

(51) Int. Cl.[7] ..... A53B 5/11; B63B 35/613

(52) U.S. Cl. ..... 482/27; 441/40; 114/311

(58) Field of Search ..... 482/23, 26, 27, 482/29, 51, 53, 74, 77; 441/40, 66, 67, 131, 30, 65, 136, 37; 5/655.3; 182/138, 139; 472/134; 52/272; 114/122, 311

(56) References Cited

U.S. PATENT DOCUMENTS

| | | | | | |
|---|---|---|---|---|---|
| 1,299,186 | A | * | 4/1919 | Imaizumi | 114/311 |
| 1,960,474 | A | * | 5/1934 | Browne | 441/131 |
| 2,627,077 | A | * | 2/1953 | Forsyth | 267/117 |
| 2,715,231 | A | * | 8/1955 | Marston | 441/127 |
| 3,047,294 | A | * | 7/1962 | Maxwell | 482/27 |
| 3,670,349 | A | * | 6/1972 | Moore | 441/125 |
| 3,781,933 | A | * | 1/1974 | Soter | 9/11 |
| 3,803,651 | A | * | 4/1974 | Moore | 441/81 |
| 4,009,675 | A | * | 3/1977 | Zollner et al. | 114/267 |
| 4,393,528 | A | | 7/1983 | West | |
| 4,576,375 | A | | 3/1986 | Roberts | |
| 4,598,904 | A | | 7/1986 | Roth | |
| 4,614,500 | A | * | 9/1986 | Miller | 114/345 |
| 4,644,892 | A | * | 2/1987 | Fisher | 482/27 |
| 4,708,676 | A | * | 11/1987 | Lin | 441/67 |
| 5,299,989 | A | * | 4/1994 | Boyd et al. | 482/27 |
| 5,351,637 | A | * | 10/1994 | Brenckmann | 114/39.14 |
| 5,383,804 | A | * | 1/1995 | Mitch et al. | 441/66 |
| 5,385,518 | A | | 1/1995 | Turner | |
| 5,779,512 | A | * | 7/1998 | Rupert | 441/123 |
| 5,810,695 | A | | 9/1998 | Sass | |
| 5,813,946 | A | * | 9/1998 | Lin et al. | 482/27 |
| D428,955 | S | * | 8/2000 | Peterson | D21/801 |
| 6,220,908 | B1 | * | 4/2001 | Peterson | 441/66 |
| 6,276,979 | B1 | * | 8/2001 | Saltel et al. | 441/132 |

FOREIGN PATENT DOCUMENTS

| | | | | |
|---|---|---|---|---|
| FR | 2698792 | * | 6/1994 | 482/27 |
| GB | 2273246 | * | 6/1994 | 482/27 |

* cited by examiner

*Primary Examiner*—Jerome W. Donnelly
*Assistant Examiner*—Victor Hwang
(74) *Attorney, Agent, or Firm*—Henderson & Sturm LLP

(57) ABSTRACT

A water trampoline including a supporting shell and a plurality of concentrically disposed inflatable rings disposed within the supporting shell to form a stable, low profile buoyant platform. A trampoline mat is attached to an inner edge of the supporting shell to resiliently support it over the central opening of the platform. A zippered access opening is provided on the inner edge of the shell below the trampoline mat to provide access to the inflatable rings.

6 Claims, 3 Drawing Sheets

WATER TRAMPOLINE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of inflatables, and more particularly to an inflatable water trampoline.

2. Description of Related Art

As can be seen by reference to the following U.S. Pat. Nos. 4,393,528; 4,576,375; 4,598,904; 5,385,518; and 5,810,695, the prior art is replete with myriad and diverse water trampolines.

Known water trampolines use a single inflatable flotation platform that supports a trampoline mat over the open center of the platform ring. When the cross sectional dimension of the ring is large, the user has difficulty in climbing from the water up onto the platform. When the cross sectional dimension of the ring is reduced to provide a low profile platform that is more easily mounted, the platform does not provide sufficient buoyancy to make the platform stable under a user's weight.

All of the aforementioned prior art constructions are generally inadequate since they are either unstable in the water, or difficult to mount. They are uniformly deficient with respect to their failure to provide a simple, efficient, and practical stable low profile trampoline for aquatic use.

As a consequence of the foregoing situation, there has existed a longstanding need for a new and improved type of stable water trampoline, and the provision of such a construction is a stated objective of the present invention.

BRIEF SUMMARY OF THE INVENTION

Briefly stated, the present invention provides a water trampoline including a supporting shell and a plurality of concentrically disposed inflatable rings disposed within the supporting shell to form a stable, low profile buoyant platform. A trampoline mat is attached to an inner edge of the supporting shell to resiliently support it over the central opening of the platform. A zippered access opening is provided on the inner edge of the shell below the trampoline mat to provide access to the inflatable rings.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
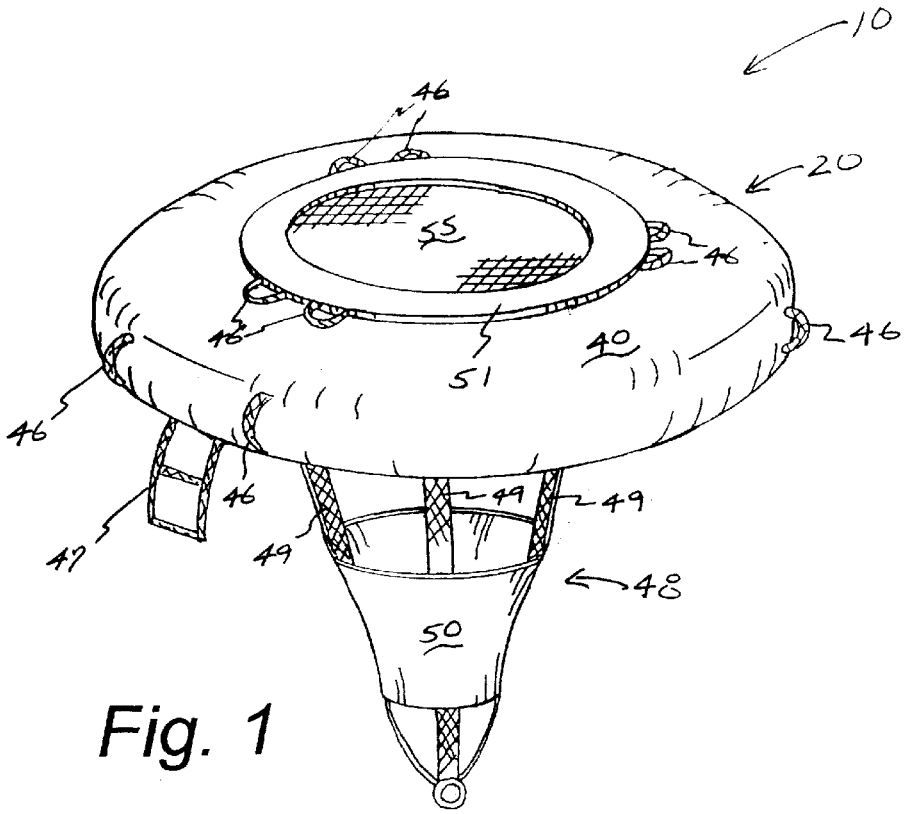
FIG. 1 is a perspective view of the water trampoline of the present invention.
Figure 2:
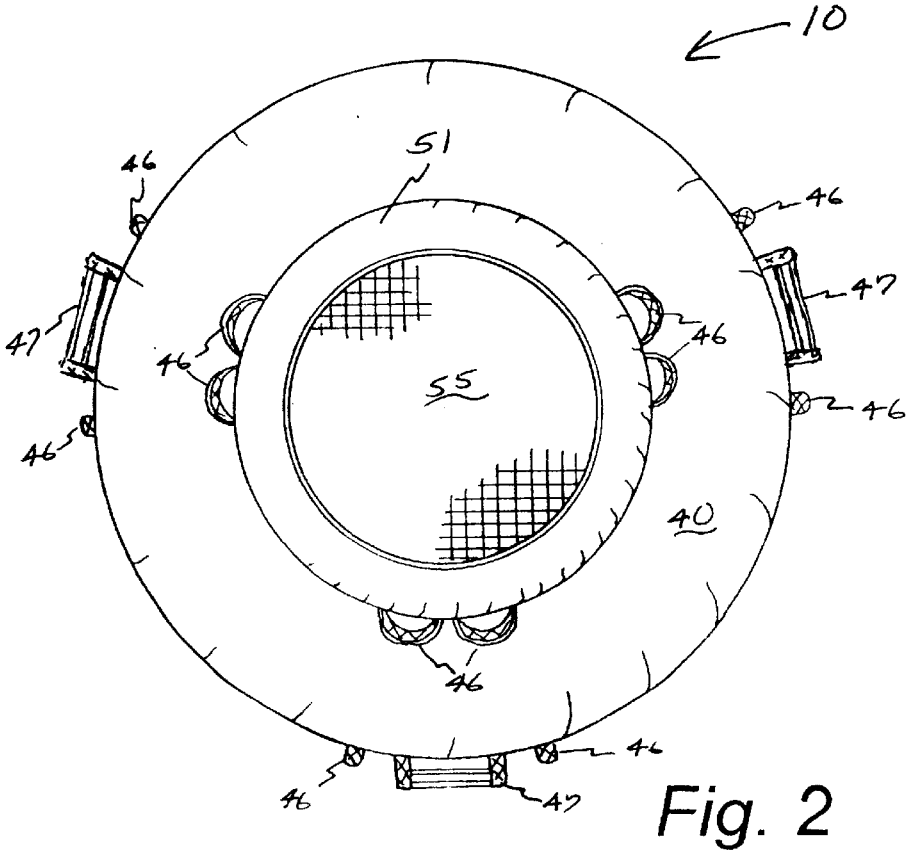
FIG. 2 is a top plan view thereof.
Figure 3:
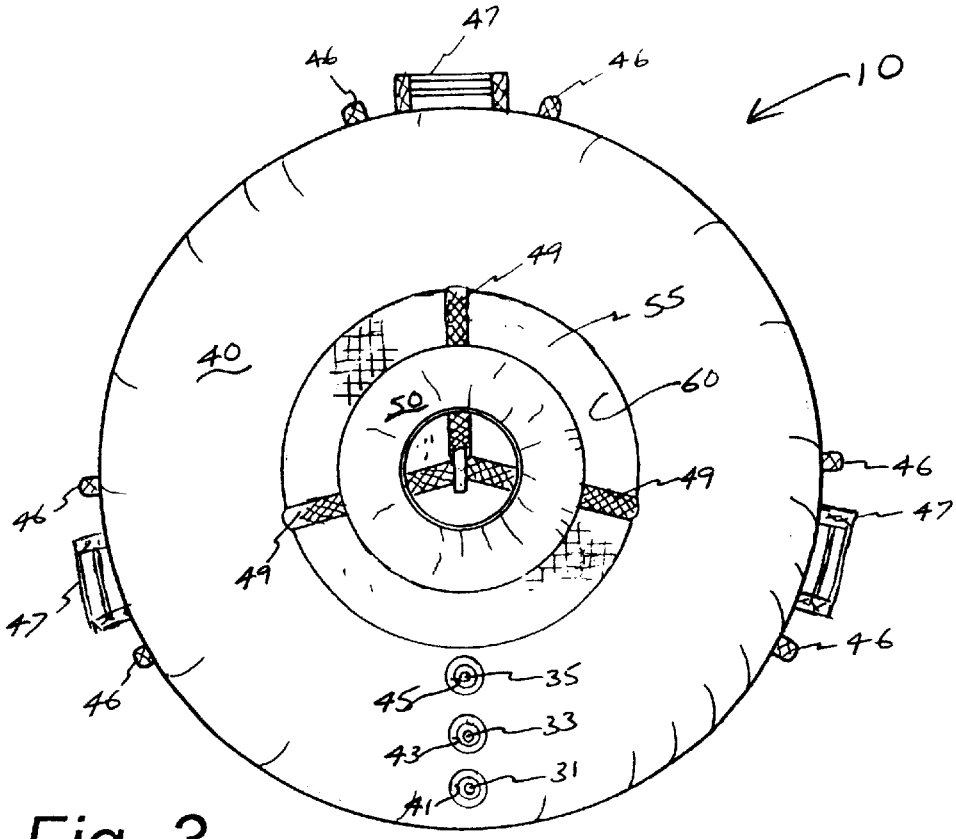
FIG. 3 is a bottom plan view thereof.
Figure 4:
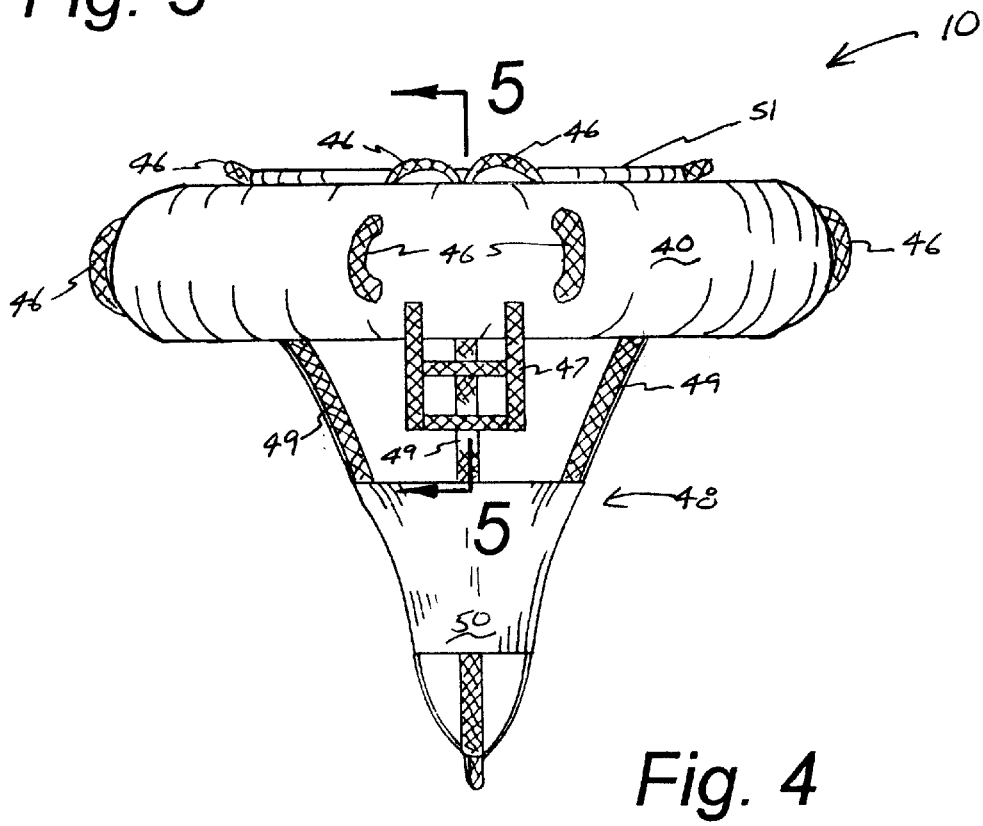
FIG. 4 is a side elevational view thereof.
Figure 5:
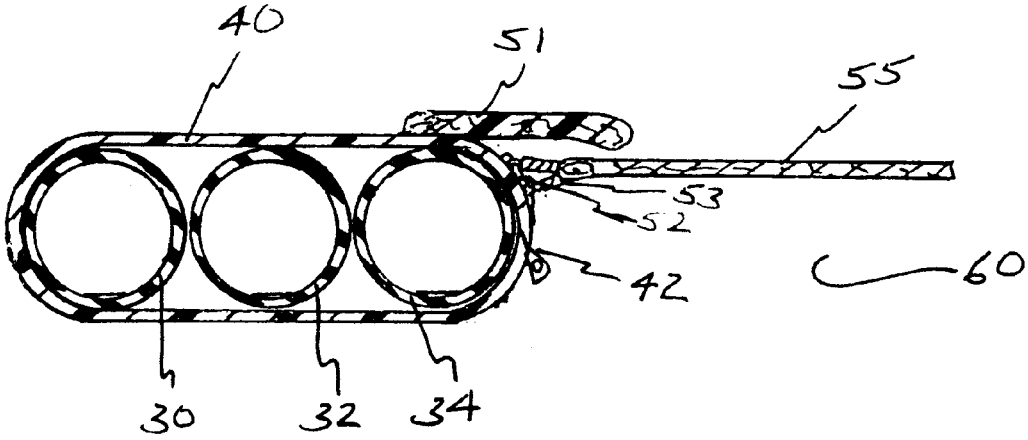
FIG. 5 is a sectional view taken along line 5—5 of FIG. 4.

As can be seen by reference to the drawings, and in particular to FIG. 1, the water trampoline that forms the basis for the present invention is designated generally by the reference number 10. The trampoline 10 includes a peripheral support platform 20 formed of three concentrically disposed inflatable rings 30, 32, 34 encased in a supporting shell 40 and having a central opening 60 (FIG. 5). The rings 30, 32, 34 are independent of one another and are separately inflatable through inflation valves 31, 33, 35. The supporting shell 40 receives the rings 30, 32, 34 through a zippered access opening 42, and they are positioned so that the inflation valves 31, 33, 35 register with openings 41, 43, 45 in the bottom side of the shell 40.

The outer edge of the shell 40 carries a number of hand grips 46 and mounting ladders 47. The underside of the shell 40 near the central opening 60 supports a sea anchor 48 which includes downwardly converging straps 49 supporting a truncated cone 50. The top side of the shell 40 carries additional hand grips 46 and a padded annular flap 51. The inner edge of the shell 40 supports an annular mounting strip 52. A trampoline mat 55 is resiliently supported over the central opening 60 by springs 53 that interconnect the mat 55 and the mounting strip 52.

In use, the first ring 30 is positioned in the shell 40 in a deflated or partially inflated state. The second and third rings 32, 34 are likewise positioned in the shell 40 and the zippered opening 42 is closed. The rings 30, 32, 34 are then fully inflated through their respective inflation valves 31, 33, 35 to snugly fit within the shell 40 to dispose the rings 30, 32, 34, in generally tangential peripheral contact with one another. The user then has the benefit of a stable low profile water trampoline that is easily accessible from the water.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A water trampoline consisting of:

a platform including a supporting shell and three coplanar concentrically disposed inflatable rings having uniform circular cross sectional configurations disposed in generally tangential peripheral contact with one another within the supporting shell, the platform supporting shell having a central opening;

a trampoline mat resiliently attached to the platform and being disposed over the central opening in the supporting shell; and, a sea anchor suspended beneath the central opening end including a plurality of downwardly converging straps supporting an inverted truncated cone at a spaced location relative to the upper and lower ends of the converging straps.

2. The water trampoline of claim 1 wherein the supporting shell includes a closeable access opening disposed to receive the inflatable rings.

3. The water trampoline of claim 2 wherein the closeable access opening is a zippered opening disposed adjacent the central opening in the supporting shell.

4. The water trampoline of claim 1 wherein each of the inflatable rings is separate from the others.

5. The water trampoline of claim 1 wherein hand grips are attached to the supporting shell.

6. The water trampoline of claim 1 wherein a mounting ladder is attached to the supporting shell.

* * * * *